United States Patent [19]

Butzen

[11] 4,419,850

[45] Dec. 13, 1983

[54] GRAVEL CURB

[75] Inventor: William J. Butzen, Menomonee Falls, Wis.

[73] Assignee: Metal Era, Inc., Waukesha, Wis.

[21] Appl. No.: 345,047

[22] Filed: Feb. 2, 1982

Related U.S. Application Data

[63] Continuation of Ser. No. 151,302, May 19, 1980.

[51] Int. Cl.[3] ..... E04D 3/40

[52] U.S. Cl. ..... 52/60; 52/94; 52/96

[58] Field of Search ..... 52/94–97, 52/56, 60

[56] References Cited

U.S. PATENT DOCUMENTS

| | | | |
|---|---|---|---|
| 3,012,376 | 12/1961 | Reddy | 52/96 |
| 3,086,324 | 4/1963 | Cheney | 52/96 |
| 3,533,201 | 10/1970 | Tyler | 52/94 |
| 3,738,068 | 6/1973 | Attaway | 52/94 |
| 4,037,372 | 7/1977 | Patry | 52/96 |
| 4,067,152 | 1/1978 | Wolna | 52/96 |
| 4,155,203 | 3/1979 | Wolna | 52/94 |
| 4,241,549 | 12/1980 | Hall | 52/60 |

FOREIGN PATENT DOCUMENTS

| | | | |
|---|---|---|---|
| 2256098 | 5/1970 | Fed. Rep. of Germany | 52/94 |
| 2230552 | 1/1974 | Fed. Rep. of Germany | 52/94 |
| 2309042 | 8/1974 | Fed. Rep. of Germany | 52/96 |
| 2012637 | 3/1970 | France | 52/94 |

*Primary Examiner*—Henry E. Raduazo

[57] ABSTRACT

A roof edging mechanism is shown as comprising a dam means adapted to be secured to the edge of the roof and to support a waterproof membrane, the dam means including an inclined portion having a lower edge engaging the roof and an upper edge, and a vertical portion having an upper edge connected to the edge of the inclined portion and a lower edge. The roof edging mechanism also includes a snap-on cap for covering at least a portion of the dam and for clamping the membrane against the dam. The snap-on cap includes a vertical portion adapted to overlie the vertical portion of the dam means, the vertical portion having a lower edge including means adapted to engage the lower edge of the vertical dam portion. The vertical portion of the snap-on also includes an upper edge, and an inclined spring portion extending downwardly from the upper edge, the inclined spring portion including a lower edge adjacent the lower edge of the inclined portion of the dam means and clamping the membrane against the lower edge of the dam portion.

9 Claims, 4 Drawing Figures

CRAVEL CURB

This application is a continuation of application Ser. No. 151,302, filed May 19, 1980.

FIELD OF THE INVENTION

The present invention relates to apparatus for use in construction of buildings and more particularly to gravel curbs employed at the edge of roofs and for securing the edges of water-proof membranes or flashing.

BACKGROUND PRIOR ART

It is desirable in some applications to cover a flat roof of a building with a waterproof membrane comprised of a rubber-like material. Such membranes are then covered with a suitable ballast such as gravel. In order to retain the gravel ballast and to control water drainage from the roof, the roof is surrounded by a gravel stop or dam. An example of such a dam is illustrated in the Hickman U.S. Pat. No. 4,071,987.

In the construction of such a roof, a sheet metal water dam-cant having a dam like configuration is secured to the edge of the roof, the water dam-cant having an upwardly and outwardly sloping surface. The water-tight membrane is commonly laid across the surface of the roof and extends up the inclined surface of the water dam-cant. Means are also provided for securing the membrane to the water dam-cant. In most instances, the sheet material is secured by an adhesive to the inclined surface and may also be secured by clamps and screws extending through the membrane into the cant. One disadvantage of such prior art constructions is that the step of securing the membrane by adhesive to the inclined surface of the cant is labor intensive and time consuming. On the other hand, it is necessary that the membrane be secured to the inclined surface of the cant and particularly to the base of the inclined surface at the juncture of the roof and the inclined surface. If the membranes is not secured to the inclined surface and the membrane is subjected to tension, the membrane may pull away from the base of the inclined surface wherein it will puncture easily. Another disadvantage of prior art arrangements is that they commonly employ a screw or nail to secure waterproof material to the inclined surface portions of the cant. Such arrangements have the disadvantage that the holes formed in the waterproof material by the nails or screws may result in eventual leakage.

For reference to prior art gravel curbs, attention is directed to the Hickman U.S. Pat. No. 4,071,987; U.S. Pat. No. Re. 26,056; U.S. Pat. No. 3,731,439; U.S. Pat. No. Re. 27,761; and U.S. Pat. No. 3,719,010.

SUMMARY OF THE INVENTION

The present invention provides an improved gravel curb or gravel stop having particular advantages in relation to securing the edges of a rubber membrane or other waterproofing roofing material at the edge of a roof, the gravel curb of the invention being less expensive to install than prior art gravel curbs, providing an improved means for firmly securing the membrane at the base of the curbs, and being designed such that the membrane is not punctured.

More particularly, the invention includes a roof edging mechanism comprising a dam means adapted to be secured to the edge of the roof, the dam means including an inclined generally planar portion having a lower edge engaging the roof, and a vertical generally planar portion extending downwardly from an upper edge of the inclined portion. The dam is adapted to provide support for a waterproof membrane. The roof edging mechanism also includes a spring means for covering at least a portion of the dam and for clamping the membrane against the dam. The spring means includes a vertical portion adapted to overlie the vertical portion of the dam means, the vertical portion having a lower edge including means adapted to engage the lower edge of the vertical portion of the dam. The spring means also includes an inclined spring portion extending downwardly from the upper edge of the vertical portion, the inclined spring portion including a lower edge adjacent the lower edge of the inclined portion of the dam means and clamping the membrane against the lower edge of the inclined portion of the dam.

The invention also includes a roof edging mechanism including a dam means adapted to be secured to the edge of a roof and comprised of a sheet of metal material, the metal material being formed such that the dam means includes a horizontal portion adapted to be secured to the roof, an upwardly inclined portion having an upper edge, and a vertical portion extending downwardly from the upper edge. The dam means so defined is adapted to support a membrane laid against the inclined portion, over the upper edge, and against the outside surface of the vertical portion. The roof edging mechanism also includes spring means for securing the membrane against the inclined portion of the dam means. The spring means is comprised of a sheet of metal material so formed as to comprise a generally vertical planar fascia portion adapted to overlie the vertical wall portion of the dam means and the membrane, the vertical planar fascia portion including a lower edge having means for engaging the lower edge of the vertical portion of the dam means. The spring means also includes an inclined portion extending downwardly from the upper edge of the fascia portion and being adapted to overlie the inclined portion of the dam means and the membrane portion being supported by the inclined portion of the dam means, the inclined portion of the spring means including a lower edge positionable adjacent the horizontal cant portion when the spring means clampingly engages the membrane.

One of the principal features of the invention is that the inclined portion of the spring means has a lower edge adjacent the horizontal portion of the cant, and the lower edge of the inclined portion of the spring means clamps and membrane against the lower edge of the inclined portion of the cant.

Various other features and advantages of the invention are set forth in the following description, in the drawings, and in the claims.

Figure 1:
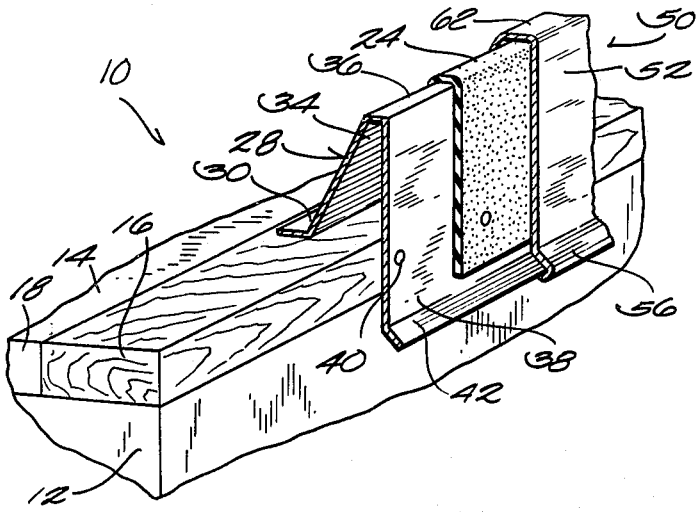
FIG. 1 is a perspective view of a gravel curb embodying the invention and with portions broken away.

Before describing the various embodiments of the invention in detail, it is to be understood that the invention is not limited in its application to the details of construction or to the arrangement of the components set forth in the following description or illustrated in the drawings. The invention is capable of other embodiments and of being practiced and carried out in various ways. Also it is to be understood that the phraseology and terminology employed herein is for the purpose of description and should not be regarded as limiting.

DESCRIPTION OF A PREFERRED EMBODIMENT

Illustrated in FIG. 1 is a gravel curb 10 secured to the edge of the roof of a building, only a portion of the building wall 12 and roof 14 being shown. In the illustrated construction the building has a conventional block wall construction, the blocks being topped with a wood nailer 16, and the roof 14 includes an insulation material covering 18 abutting the wood nailer 16 and with the upper surface 20 of the insulation 18 being coplanar with the upper surface 22 of the wood nailer 16.

The roof 14 is also covered with a sheet or layer of a rubberlike waterproof membrane 24 adapted to bar moisture from penetrating the roof. While the membrane 24 may be comprised of a variety of materials, an example of a suitable membrane is one comprised of ethylene-propylene terpolymer, also referred to as an ethylene propylene diene monomer (EPDM). Ballast 26 is employed to secure the rubber sheet membrane 24 to the roof. Such ballast can comprise relatively course gravel or rocks. While in the particular embodiment of the invention shown in the drawings, the waterproof material covering the roof is a single-ply membrane 24, in other applications other roofing materials such as conventional multilayer materials could also be used.

The gravel curb 10 is intended to provide a means for securing the edges of the rubber membrane 24 to the edge of the roof, to restrain the ballast or gravel 26, and to control the flow of water on the roof. The gravel curb 10 is comprised of a water dam-cant or dam means 28 adapted to be nailed or otherwise fixedly secured to the wood nailer 16 at the edge of the roof. The cant 28 is comprised of metal sheet material such as galvanized sheet metal or sheet aluminum. In the particular construction illustrated, the cant includes a horizontal flange portion 30 which is secured by nails 32 to the upper surface 22 of the wood nailer 16. The cant 28 also includes an upwardly inclined portion 34 extending from the horizontal portion 30 and upwardly and outwardly toward the edge of the roof. The upper edge of the inclined portion terminates in a flat or horizontal portion 36. The cant 28 also includes a vertical portion 38 extending downwardly from the upper portion 36, the vertical portion 38 being adapted to be secured by nails 40 or other means to the wood nailer 16. The lower edge 42 of the vertical portion 38 of the cant 28 is shown as being bent so as to extend downwardly and outwardly from the wall of the building.

During construction of a building employing the invention, the rubber membrane 24 is laid on the surface of the roof after the cant 28 has been secured in place. The membrane 24 is adapted to extend up the inclined surface 34 and downwardly against the outside of the vertical wall 38 of the cant. In a preferred form of the invention nails 40 are driven through the membrane and the vertical portion 38 of the cant into the side of the wood nailer 16.

Means are also provided for mechanically securing the membrane 24 against the inclined surface 34 of the cant and particularly for securing the membrane 24 against the lower portion 44 of the inclined surface 34 such that tensile forces on the rubber membrane 24 in the direction away from lower portion 44 will not pull the membrane away from its supporting surface of the inclined portion 34 of the cant. More specifically, such mechanical securing means comprises a spring means or a snap-on cap 50 having a fascia portion 52 overlying the vertical portion 38 of the cant 28 and a spring means 54 overlying the inclined portion 34 of the cant. The snap-on cap 50 is comprised of sheet material such as galvanized steel or aluminum but particularly such metal having spring properties.

The fascia or vertical portion 52 of the snap-on cap 50 is adapted to cover the outside of the membrane 24 and includes a lower end portion 56 bent so as to include a downwardly and outwardly extending portion 58 and an inwardly extending lip 60 thereby defining a channel for receiving the downwardly 38 of the cant. The upper end of the fascia portion 52 terminates in a horizontal portion 62 adapted to overlie the horizontal flat portion 36 of the cant.

Figure 2:
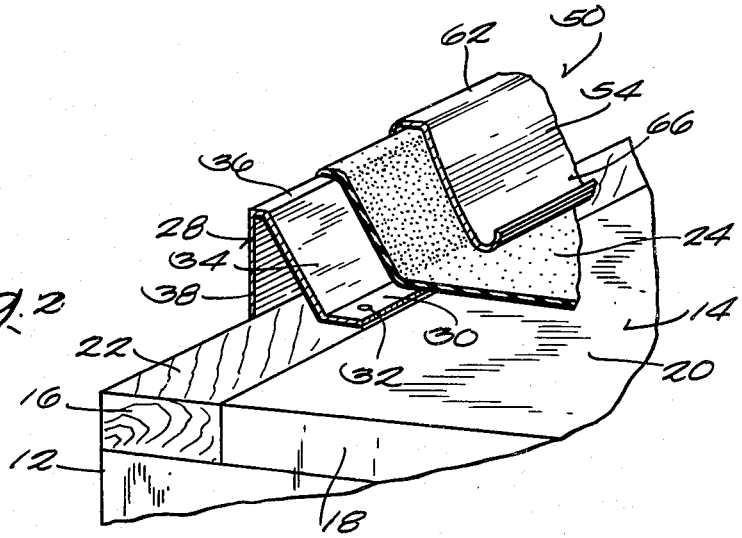
FIG. 2 is a second perspective view of the gravel curb shown in FIG. 1.
Figure 3:
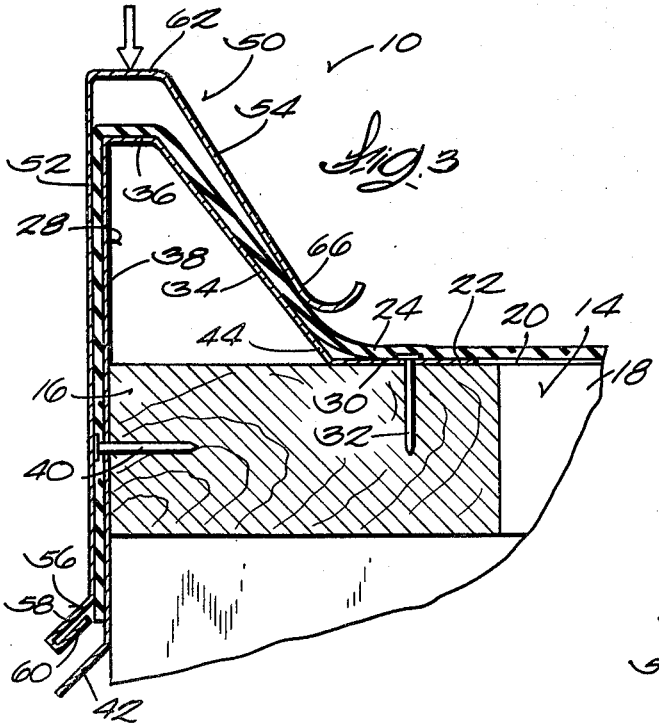
FIG. 3 is an enlarged cross-section view of the gravel curb shown in FIGS. 1 and 2 but with the snap-on cap of the gravel curb in a raised position.
Figure 4:
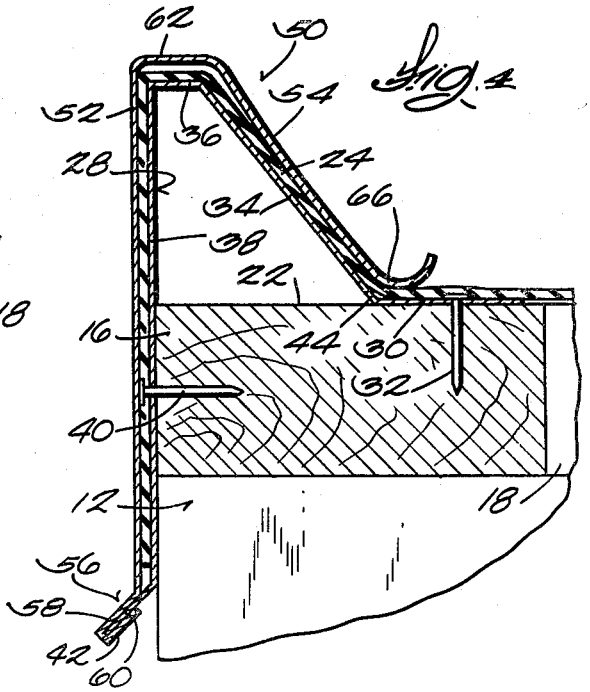
FIG. 4 is a view similar to FIG. 3 but with the snap-on cap in a secured position.

The inclined portion 54 of the spring means 50 has an upper end joining the upper portion 62 of the spring means and is adapted to overlie the inclined portion 34 of the cant and the membrane portion thereon. The spring sheet metal comprising the spring means 50 is bent or formed in such a manner that when the spring means is forced down on the membrane and the cant as illustrated in FIGS. 2 and 3, the lower edge portion 66 of the inclined surface 54 of the spring means 50 will apply a force on an adjacent portion of the membrane thereby clamping it against the lower edge 44 of the inclined portion 34 of the cant.

In a preferred construction, the lower edge 66 of the inclined portion 54 of the spring means 50 has an upturned rolled or rounded configuration. By providing such a configuration, the snap-on cap 50 will not tear the membrane 24 as the cap is forced down onto the cant 28. Such a configuration also further prevents the possibility of tearing of the membrane 24 in the event that a tensile force is applied to the edge of the membrane and tending to pull it away from the cant.

It will be noted that during installation of the snap-on cap 50, as it is forced downwardly over the cant 28, the lower edge 56 of the fascia portion 52 will slide downwardly and outwardly on the external surface of the outwardly inclined portion 42 of the cant. When the snap-on cap 50 is firmly in place, the lip 60 will then snap under the lower edge of the vertical portion of the cant and such that the snap-on cap 50 will be secured in place.

One of the advantages of the invention is that the snap-on cap 50 secures the membrane in place in such a manner as to preclude the steps otherwise necessary to secure the membrane to the inclined surface with glue or adhesive. This saves a substantial amount of installation labor costs. Another advantage of the invention is that by employing the roof edging apparatus described above, it is unnecessary to drive nails through the portion of the membrane extending up the inclined portion of the cant. The only punctures or holes in the membrane are those made by nails 40 adjacent the outside of the cant, and water leakage problems are thereby avoided. Another substantial advantage of the invention is that the snap-on cap 50 can be secured in place by merely forcing it down onto the cant wherein it will engage the cant. Use of other securing means is unnecessary.

Various other features and advantages of the invention are set forth in the following claims.

I claim:

1. A roof edging mechanism for providing a dam at the edge of a roof and for securing the edge of a rubber membrane overlying the roof in place, the roof edging mechanism comprising a dam means adapted to be secured to the edge of a roof, the dam means including an inclined portion having a lower edge engaging the roof and having an upper edge, and a vertical portion having an upper edge connected to the upper edge of the inclined portion, said vertical portion having a lower edge spaced from said lower edge of said inclined portion, and said dam being adapted to support a rubber membrane thereon, and a fascia for covering at least a portion of said dam means and for clampingly engaging said rubber membrane where said lower edge of said inclined portion of said dam means engages the roof, said fascia including a vertical portion adapted to overlie said vertical portion of said dam means, said vertical portion having a lower edge including means adapted to engage the lower edge of said vertical dam portion, to releasably restrain said fascia against upward movement and said vertical portion of said fascia having an upper edge, and an inclined spring portion extending downwardly from said fascia vertical portion upper edge, said inclined spring portion including a lower edge adjacent said lower edge of said inclined portion of said dam means and said inclined spring portion of said fascia being resilient and being constructed such that said lower edge of said inclined spring portion clampingly engages said membrane where said lower edge of said inclined dam portion engages the roof, said fascia being adapted to be forced downwardly over said dam means to clamp said rubber membrane in place on said dam means, and said lower edge of said inclined spring portion being freely slideable on said rubber membrane as said spring means is forced downwardly over said dam means.

2. A roof edging mechanism as set forth in claim 1 wherein said fascia is comprised of metal sheet material and wherein said dam means is comprised of metal sheet material.

3. A roof edging mechanism as set forth in claim 1 wherein said means adapted to engage the lower edge of said vertical dam portion comprises a channel portion having a lip, said lip being receivable under said lower edge of said dam vertical portion when said fascia is forced downwardly.

4. A roof edging mechanism for providing a dam at the edge of a roof and for securing the edge of a rubber membrane overlying the roof in place, the roof edging mechanism comprising dam means adapted to be secured to the edge of the roof and comprised of a sheet of metal material, said dam means including a horizontal portion adapted to be secured to the roof, an upwardly inclined portion extending from said horizontal portion, said upwardly inclined portion having an upper edge, and a vertical portion extending downwardly from said upper edge, said vertical portion including a lower edge and an outside surface, said dam means being adapted to support a rubber membrane laid against said inclined portion, over said upper edge, and against said outside surface of said vertical portion, and a fascia for securing said rubber membrane against said lower edge of said inclined portion of said dam means and against said roof, said fascia being comprised of a sheet of resilient metal material including a generally vertical planar fascia portion adapted to overlie said vertical wall portion of said dam means and said membrane, said vertical planar fascia portion including a lower edge having means for selectively engaging said lower edge of said vertical portion of said dam means, and an upper edge, and an inclined portion extending downwardly from said vertical planar fascia portion upper edge and adapted to overlie said inclined portion of said dam means and the rubber membrane portion supported by said inclined portion of said dam means, said inclined portion of said fascia including a rounded lower edge and said inclined fascia portion being resilient such that said rounded lower edge clamps said membrane against said horizontal cant portion and against said lower edge of said inclined portion of said dam means when said lower edge of said vertical planar fascia portion engages said lower edge of said dam means vertical portion said fascia being adapted to be forced downwardly over said dam means to clamp said rubber membrane in place on said dam means, and said rounded lower edge of said inclined spring portion being freely slideable on said rubber membrane as said spring means is forced downwardly over said dam means.

5. A roof edging mechanism as set forth in claim 4 and wherein said inclined portion of said spring means has a lower edge adjacent said horizontal portion, said lower edge of said inclined portion of said spring means clamps said membrane against said lower edge of said inclined cant portion.

6. A fascia, flashing and water dam assembly for being installed on a building adjacent to a wall and to the edge of the building roof and comprising a dam means adapted to be secured to the edge of the roof, the dam means including an inclined portion having an upper edge and having a lower edge engaging the roof, and a vertical portion having an upper edge connected to the upper edge of the inclined portion, the vertical portion also having a lower edge spaced from said lower edge of said inclined portion and adapted to be secured to the wall, and said dam being adapted to support a rubber membrane thereon, and a fascia for covering at least a portion of said dam means and for clamping said rubber membrane against said lower edge of said inclined portion of said dam means and against the roof, said fascia being resiliently movable downwardly from a first position, to a downwardly extending position, to a third position intermediate said first position and said downwardly extended position, and said fascia including a vertical portion adapted to overlie said vertical portion of said dam means, said vertical portion of said fascia having a lower edge including hook means adapted to extend around the lower edge of said vertical portion of said dam means when said fascia is moved to said downwardly extended position and to engage the lower edge of said vertical dam portion thereby preventing upward movement of the fascia when said fascia moves to said intermediate position, and said vertical portion of said fascia having an upper edge, and said fascia including an inclined spring portion extending downwardly from said upper edge of said fascia vertical portion and adapted to overlie said inclined portion of said dam means, said inclined portion of said fascia being resiliently flexible away from said inclined portion of said dam means, and said inclined portion of said spring portion means including a rounded lower edge adjacent said lower edge of said dam means inclined portion and adapted to slide down said inclined portion of said dam means to a position adjacent said roof when said spring means is moved to said downwardly extended position and adapted to clamp said membrane against said lower edge of said inclined dam portion and against the roof when said spring means moves to said third position.

7. A roof edging mechanism adapted to provide a dam at the edge of a roof and to provide a means for securing the edge of a rubber membrane to the edge of the roof, the roof edging mechanism comprising a dam means adapted to be secured to a roof and adjacent to a wall, the dam means including an inclined portion having a lower edge engaging the roof and having an upper edge, and a vertical portion connected to the inclined portion and adapted to extend downwardly with at least a portion of said vertical portion being adjacent the wall, said vertical portion having a lower edge, and said dam being adapted to support a rubber membrane thereon, and a fascia for covering at least a portion of said dam means and for clamping engaging the portion of said rubber membrane in the area where said lower edge of said inclined portion of said dam means engages the roof, said fascia including a vertical portion adapted to overlie said vertical portion of said dam means, said fascia vertical portion having a lower edge including means adapted to engage the lower edge of said vertical dam portion, and said vertical portion of said spring means having an upper edge, and said fascia including an inclined spring portion extending downwardly from said vertical portion upper edge, said inclined spring portion including a lower edge adjacent said lower edge of said inclined portion of said dam means and said inclined spring portion of said fascia being resilient and being constructed such that said lower edge of said inclined spring portion clampingly engages said membrane in the area where said lower edge of said inclined dam portion engages the roof, said fascia being adapted to be forced downwardly over said dam means to clamp said rubber membrane in place on said dam means, and said lower edge of said inclined spring portion being freely slideable on said rubber membrane as said spring means is forced downwardly over said dam means.

8. A roof edging mechanism as set forth in claim 7 wherein said means adapted to engage the lower edge of said vertical dam portion comprises a channel portion having an upwardly extending lip, said lip being receivable under said lower edge of said dam vertical portion when said fascia is deflected downwardly.

9. A roof edging mechanism comprising dam means adapted to be secured to the edge of a roof, said dam means including an upwardly extending portion including a lower edge adapted to be secured to the roof and an upper edge, and a vertical portion connected to said upwardly extending portion and extending downwardly with respect to the edge of the roof, said vertical portion including an outside surface and including a lower edge, said dam means being adapted to support a rubber membrane laid against said upwardly extending portion, over said upper edge, and against said outside surface of said vertical portion, and a fascia for securing said membrane in place in the area where said upwardly extending portion engages the roof, said fascia being comprised of a sheet of resilient material including a generally vertical planar fascia portion adapted to overlie said vertical portion of said dam means and said membrane, said vertical planar fascia portion including a lower edge having means for selectively engaging said lower edge of said vertical portion of said dam means, and an upper edge, and a clamping portion extending downwardly from said fascia portion upper edge and adapted to overlie said upwardly extending portion of said dam means and the portion of the membrane supported by said upwardly extending portion of said dam means, said clamping portion of said fascia including a lower edge adapted to secure said membrane against the roof adjacent said lower edge of said upwardly extending portion of said dam means when said lower edge of said vertical planar fascia portion engages said lower edge of said dam means vertical portion.

* * * * *

UNITED STATES PATENT AND TRADEMARK OFFICE

CERTIFICATE OF CORRECTION

PATENT NO. : 4,419,850

DATED : December 13, 1983

INVENTOR(S) : William J. Butzen

It is certified that error appears in the above—identified patent and that said Letters Patent is hereby corrected as shown below:

Column 1, in the title, delete "CRAVEL" and substitute -- GRAVEL --.

Column 4, line 21, following "downwardly" insert -- and outwardly inclined portion 42 of the vertical portion --.

Column 7, line 13, delete -- means --.

Signed and Sealed this

*Thirty-first* Day of *July 1984*

[SEAL]

*Attest:*

GERALD J. MOSSINGHOFF

*Attesting Officer*

*Commissioner of Patents and Trademarks*